US005115963A

United States Patent [19]

Yasui

[11] Patent Number: 5,115,963

[45] Date of Patent: May 26, 1992

[54] SUPERPLASTIC FORMING OF PANEL STRUCTURES

[75] Inventor: Ken K. Yasui, Huntington Beach, Calif.

[73] Assignee: McDonnell Douglas Corporation, Long Beach, Calif.

[21] Appl. No.: 712,732

[22] Filed: Jun. 10, 1991

[51] Int. Cl.[5] ..... B23K 31/02; B21D 39/00

[52] U.S. Cl. ..... 228/157; 228/181; 228/193

[58] Field of Search ..... 228/157, 181, 193, 265

[56] References Cited

U.S. PATENT DOCUMENTS 4,087,037 5/1978 Schier et al. ..... 228/193
4,483,478 11/1984 Schulz ..... 228/265
4,811,890 3/1989 Dowling et al. ..... 228/157

FOREIGN PATENT DOCUMENTS 0859065 8/1981 U.S.S.R. ..... 228/183

*Primary Examiner*—Kurt Rowan
*Assistant Examiner*—Jeffrey T. Knapp
*Attorney, Agent, or Firm*—Max Geldin

[57] ABSTRACT

Process for making a panel structure by superplastic forming from a pair of face sheets disposed on opposite sides of a core sheet, the core sheet being bonded as by welding to the face sheets along a plurality of spaced weld areas, the core sheet and face sheets having superplastic characteristics, which comprises placing a restraining sheet of superplastic material in contact with one of the face sheets and subjecting the forming pack of the face sheets and core sheet, together with the restraining sheet, to superplastic forming in a die while applying a back pressure against the restraining sheet. The back pressure is lower than the internal pressure and maintains the restraining sheet in contact with the adjacent face sheet while maintaining the other face sheet in contact with a surface of the die. After superplastic forming the resulting panel structure formed of a core web and attached face sheets, and the restraining sheet, are removed from the die and the restraining sheet is separated from the panel structure. The process results in a panel structure with flat face sheets, and without grooves or wrinkles at the areas of the bonds between the face sheets and core sheet.

17 Claims, 2 Drawing Sheets

FIG. 1
PRIOR ART
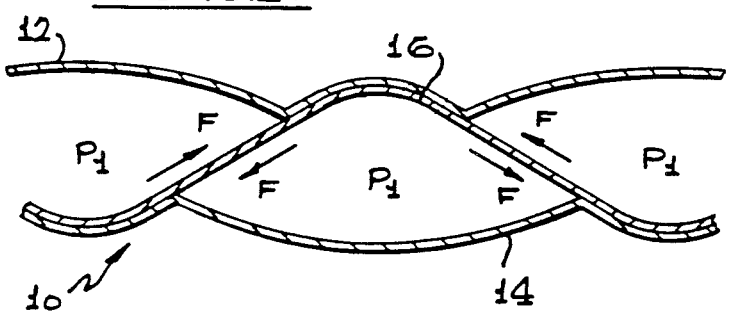
FIG. 2
PRIOR ART
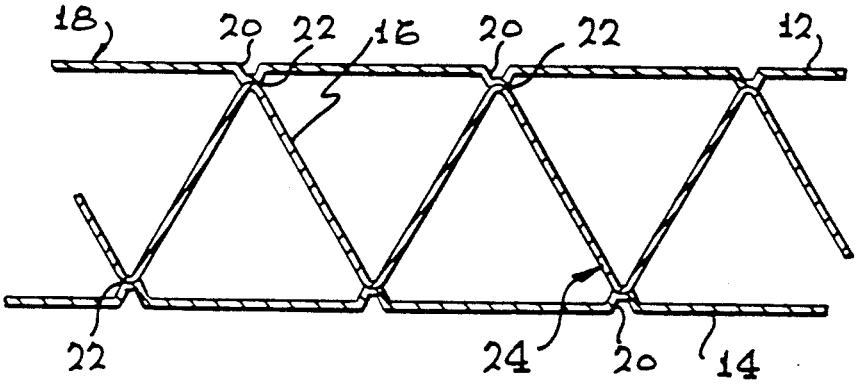
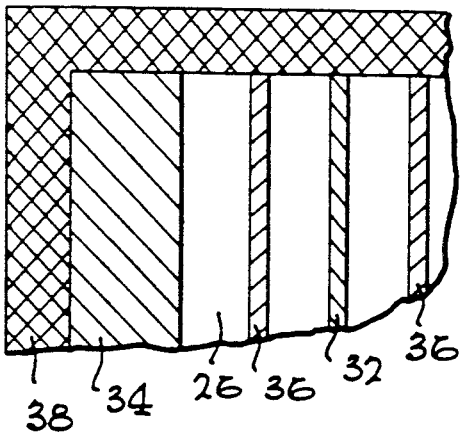
FIG. 3
FIG. 9
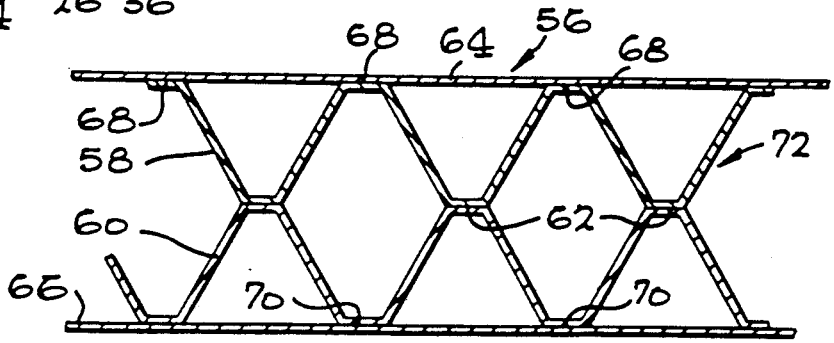

SUPERPLASTIC FORMING OF PANEL STRUCTURES

BACKGROUND OF THE INVENTION

This invention relates to the production of superplastically formed panel structures, and is more particularly directed to a process for superplastic forming of a plurality, e.g. of three, sheets, namely, a core sheet and two face sheets joined together as by welding into a panel structure, without formation of wrinkles or grooves in the face sheets at the points of attachment, e.g. welds, with the core sheet.

When a face sheet of a superplastic forming pack is joined to a core sheet by diffusion bonding, welding, and the like, followed by superplastic forming to produce a panel structure in conventional practice, face sheet grooves or wrinkles, commonly called "eye brow", occurs during forming caused by core sheet pulling forces. This is illustrated in FIG. 1 of the drawing. Thus, during superplastic forming of the forming pack 10 comprised of face sheets 12 and 14 and core sheet 16, the forming pressurization at $P_1$ generates an excessive face sheet pulling force F on core sheet 16 which results in a core panel 18, as seen in FIG. 2, having undesirable grooves 20 in the face sheets 12 and 14 at their points of attachment, namely welds 22, with the core sheet 16, forming the web 24 of the panel structure. Once the face sheets stretch during superplastic forming, they cannot be contracted or shrunk to avoid this problem.

U.S. Pat. No. 4,811,890 to Dowling et al discloses a process for eliminating core distortion in diffusion bonded and superplastically formed structures wherein following superplastic forming and release of the internal gas pressure and during cooling of the metal panel structure and while the metal panel is still at a temperature where the metal remains flexible, a low internal differential pressure is introduced into the interior of the panel, expanding the panel out to its original form against the die as a restraint, and straightening the thin core cell walls of the panel which were distorted following superplastic forming.

However, the above patent does not address the problem of avoiding wrinkles or grooves in the face sheets of a superplastically formed core panel formed of a core sheet bonded as by diffusion bonding or welding to face sheets, at the bonded areas of the face sheets and the core sheet.

It is an object of the present invention to provide a process for eliminating face sheet wrinkles or grooves in a core panel formed during superplastic forming of the core panel.

Another object is the provision of simplified procedure including means in conjunction with a superplastic forming pack comprised of a core sheet bonded, as by welding or the like, to a pair of face sheets, to prevent grooves or wrinkles in the face sheets at the bonded areas of the core sheet with the face sheets, caused by core sheet pulling forces during superplastic forming.

Still another object is to provide a process of the above type wherein the core sheet and face sheets of the superplastic forming pack are comprised of titanium or aluminum, or other superplastic materials.

Yet another object is the provision of an improved core panel or structure produced by the above process.

Other objects and advantages of the invention will appear hereinafter.

SUMMARY OF THE INVENTION

It has been found according to the present invention that grooves or wrinkles in the face sheets of a core panel produced during superplastic forming of a core pack comprised of a superplastic core sheet joined or bonded to opposite superplastic face sheets, as by welding or diffusion bonding, can be eliminated by placing a restraining superplastic sheet in contact with one of the face sheets and during superplastic forming, applying a back pressure against the restraining sheet to maintain the latter sheet in contact with the adjacent face sheet and maintaining the other face sheet in contact with a surface of the forming die. The presence of the restraining sheet and the application of a back pressure against it during superplastic forming of the assembly, function to restrain superplastic forming of the core sheet and to restrain and substantially reduce the pulling force of the face sheets with respect to the core sheet and to maintain the face sheets flat, and thus prevent grooving of the face sheets at the bonded, e.g. welded, areas of attachment of the core sheet to the face sheets.

The restraining sheet can have the superplastic forming characteristics of the core sheet and face sheets, but is generally thicker than the face sheets so that it becomes stiffer than the individual face sheets.

If desired, as a further feature of the invention, an additional non-superplastic sheet such as a steel sheet can be placed between the restraining sheet and the adjacent face sheet. By this feature the thickness of such superplastic restraining sheet can be reduced, thus reducing the cost thereof and rendering the process more economical.

Thus, the invention is directed to a process for providing a panel structure which comprises providing at least one core sheet and a pair of face sheets disposed on opposite sides of said core sheet, said core sheet and at least one of said face sheets comprised of a superplastic material, said core sheet being joined to said face sheets along a plurality of spaced bonded areas, sealing the perimeter of said joined core sheet and face sheets, placing a restraining sheet in contact with said at least one of said face sheets, said restraining sheet comprised of superplastic material, providing a die having upper and lower surfaces and defining a cavity therebetween, placing the resulting assembly of core sheet, face sheets and restraining sheet in said cavity, with the other face sheet in contact with the lower die surface, heating said assembly to a temperature suitable for superplastic forming and admitting pressurized gas between said core sheet and each of said face sheets to cause superplastic forming of said core sheet and said at least one face sheet between said bonded areas, while superplastically forming said restraining sheet and applying a back pressure against said restraining sheet, thereby straining the core sheet and maintaining said restraining sheet in contact with the adjacent face sheet and maintaining the other face sheet in contact with the lower die surface, during superplastic forming, and forming a panel structure comprised of a core web bonded to flat face sheets along a plurality of bonded areas, without face sheet grooving at the areas of the bonds.

According to a preferred embodiment, a single core sheet and two face sheets are employed to produce a final three sheet structure. Also, in preferred practice, welding is employed for bonding the core sheet to the face sheets.

BRIEF DESCRIPTION OF THE DRAWINGS

FIG. 1 is an exaggerated illustration of the generation of grooves or wrinkles in the face sheets of a conventional superplastic forming pack of a core sheet bonded as by welding to a pair of face sheets, during conventional superplastic forming;

FIG. 2 illustrates a cross-section of a core panel resulting from superplastic forming of the forming pack of FIG. 1, showing production of undesirable grooving in the face sheets;

FIG. 3 is a plan view, partly broken away of a forming pack comprised of a pair of superplastic face sheets bonded in a plurality of areas to an intermediate superplastic core sheet;

FIG. 9 illustrates a modification of the invention concept to produce a four sheet panel structure.

DETAILED DESCRIPTION OF THE INVENTION AND PREFERRED EMBODIMENTS

Figure 4:
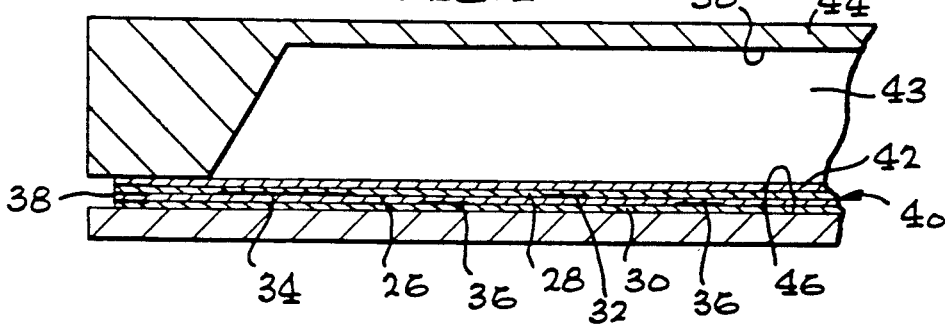
FIG. 4 illustrates a forming pack comprised of bonded core sheet and face sheets, as illustrated in FIG. 3, and a restraining sheet according to the invention, in a forming die before pressurization and superplastic forming.

Referring to FIGS. 3 and 4 of the drawings, panel structures according to the invention are produced by combining a core sheet 26 and a pair of face sheets 28 and 30 by superplastic forming. The members 26, 28 and 30 to be superplastically formed must exhibit the characteristics of high tensile elongation with minimum necking when deformed within a limited temperature and strain rate range. While several materials demonstrate these superplastic properties, titanium alloys are currently the best known superplastic forming materials. Aluminum is also suitable for this purpose. Various non-metallic materials may also be suitable, such as fiber reinforced "Peek" (polyether ether ketone) resin composites. The superplastic temperature range varies with the specific alloy used. This temperature for titanium is 1700° F. and for aluminum is 900° F. By the term "superplastic" material employed herein is meant materials having the aforementioned superplasticity characteristics.

The core sheet 26 is bonded to the upper face sheet 28 as by a series of spaced apart welds 32 and the larger area end weld 34. The core sheet 26 is also bonded to the lower face sheet 30 by a series of spaced welds 36, the welds 36 being staggered or positioned intermediate the welds 32. The core sheet 26 is also sealed as by welding at 38 around the perimeter of the sheets to both of the face sheets 28 and 30. Any type of bonds or welds can be employed such as roll bond, diffusion bond or adhesive bond, for joints 32, 34 and 36. The perimeter weld 38 is a continuous sealing weld. The result is the forming pack assembly 40. Instead of bonding the core sheet to the face sheets by welding, as shown, diffusion bonding can be employed referring to the solid state, metallurgical joining of surfaces of similar or dissimilar metals by applying heat and pressure for a time duration to effect intimate surface contact and cause comingling of atoms at the join surfaces. Inlet means (not shown) is provided for introduction of pressurized gas between the core sheet 26 and the lower face sheet 30, and between core sheet 26 and the upper face sheet 28.

According to the invention, a fourth restraining sheet 42 is placed over the upper face sheet 28 of the forming pack 40. The restraining sheet is also comprised of a superplastic material, and can be the same superplastic material as the core sheet and face sheets of the forming pack 40. However, the fourth sheet 42 preferably has a thickness greater than the thickness of the face sheets and hence is stiffer than the face sheets. For example, the face sheets 28 and 30 and core sheet 26 can be titanium sheets having a thickness of 0.025" and the fourth restraining sheet can be titanium having a thickness of 0.050".

However, where the fourth sheet 42 is comprised of a superplastic material which is substantially stiffer than the superplastic material of the core sheet of the forming pack 40, sheet 42 can be less thick than the face sheets. Thus, the face sheets can be comprised of 6A1-4V titanium alloy and the restraining sheet 42 of a stiffer titanium alloy such as Ti-6A1-2Sn-4Zr-2Mo.

Figure 5:
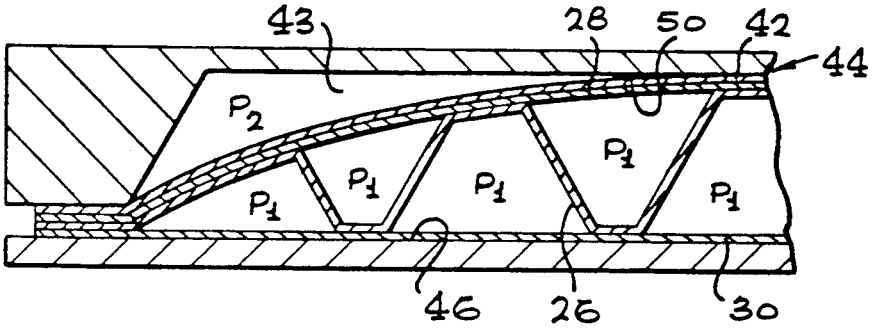
FIG. 5 illustrates the positions of the forming pack and restraining sheet of FIG. 4 during superplastic forming in the die.

The resulting assembly of forming pack 40 and the restraining sheet 42 are placed in the cavity 43 of a heated die 44, as illustrated in FIG. 4. During the superplastic forming process, as illustrated in FIG. 5, an internal pressure $P_1$ is applied by introduction of pressurized gas into the spaces between the core sheet 26 and each of the face sheets 28 and 30 to initiate superplastic forming of the forming pack 40 while a pressure $P_2$ which is substantial but less than $P_1$ is applied against the restraining sheet 42. The actual forming pressure is the difference in pressure between $P_1$ and $P_2$. This differential forming pressure strains the core sheet 26. Pressure $P_1$ maintains the fourth sheet 42 in contact with the adjacent upper face sheet 28. $P_1$ also forces the bottom face sheet 30 into contact with the bottom surface 46 of the die, and maintains the face sheet 30 in flat condition during superplastic forming. The amount of superplastic forming of the core sheet 26 and the upper face sheet 28 is controlled by the differential pressure between the internal pressure $P_1$ and the back pressure $P_2$ against the fourth sheet 42, so as to prevent face sheet grooving.

For example $P_1$ can be 300 psi and $P_2$ 250 psi, with a differential effective superplastic forming pressure $P_1$-$P_2$ of 50 psi. The pressure of the fourth sheet 42 against face sheet 28 and the pressure of face sheet 30 against the bottom die surface 46 maintains both face sheets 28 and 30 flat during superplastic forming and restrains formation of grooves or wrinkles at the welded areas 32, 34 and 36 between the core sheet and the face sheets. The required magnitude of the back pressure $P_2$ to prevent the face sheets 28 and 30 from wrinkling or forming grooves at the weld areas with the core sheet depends on the core sheet thickness, width of the bond areas, restraining sheet thickness and angle formed between core sheet and face sheets.

Figure 6:
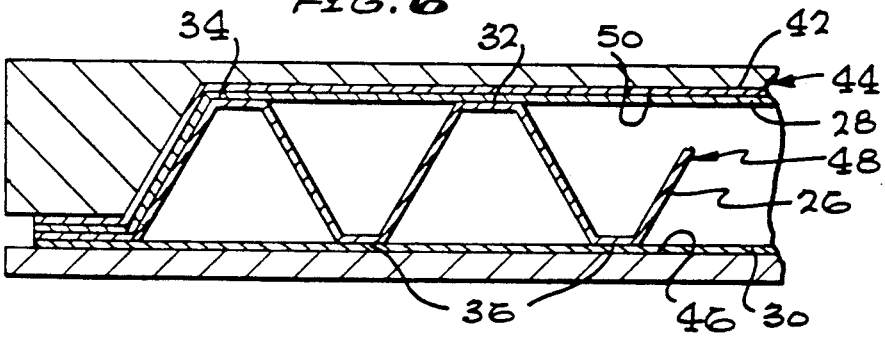
FIG. 6 illustrates forming the completed core panel in the die by continued pressurization therein.
Figure 7:
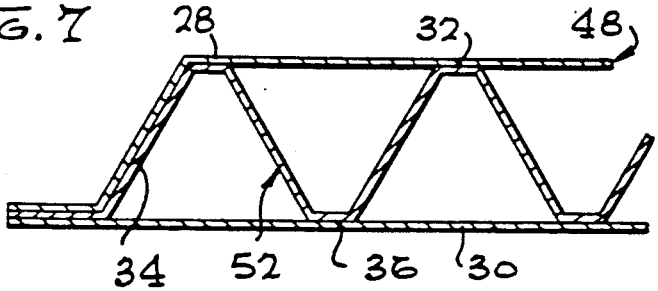
FIG. 7 shows the completed superplastically formed three sheet panel structure of FIG. 6, removed from the die and free of any grooves or wrinkles in the face sheets.

Pressurization and superplastic forming is continued until complete formation of the finished panel structure 48 shown in FIG. 6, with the restraining sheet 42 and contiguous face sheet 28 in contact with the top surface 50 of die 44. It will be seen that in the final panel structure 48 the face sheets 28 and 30 remain smooth, with no grooves or wrinkles therein at the weld areas 32, 34 and 36. After superplastic forming, the final panel structure 48 and restraining sheet 42 are removed from the die 44, and the restraining sheet 42 is then separated from the panel structure. The final panel structure 48 following removal from the die is shown in FIG. 7, with the initial core sheet 26 superplastically formed into a web 52 between wrinkle-free face sheets 28 and 30.

Figure 8:
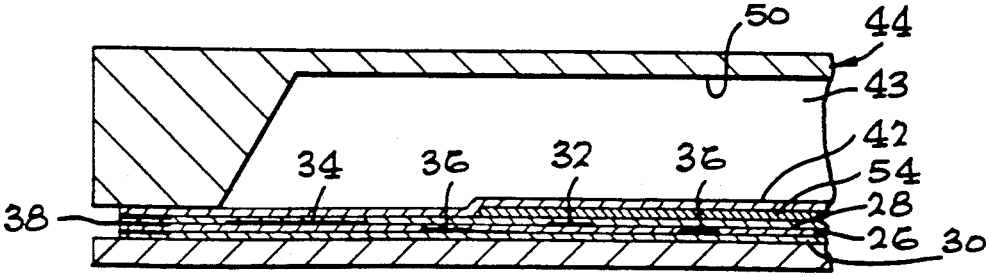
FIG. 8 illustrates a modification of FIG. 4, including insertion of a non-superplastic sheet between the restraining sheet and the adjacent face sheet of the forming pack.

According to another feature of the invention, referring to FIG. 8, if desired, a non-superplastic metal sheet 54 such as a steel sheet can be inserted between the restraining sheet 42 and the adjacent upper face sheet 28. The non-superplastic sheet only extends for a portion of the area of the restraining sheet 42 and the contiguous face sheet 28. During superplastic forming, the non-superplastic sheet 54 does not expand. The use of a non-superplastic metal sheet 54 such as steel, together with sheet 42, functions to maintain the adjacent face sheet 28 flat during superplastic forming and permits the use of a thinner superplastic restraining sheet 42, and hence reducing cost. As an example, titanium face sheets 28 and 30 and core sheet 26, of 0.025" thickness, can be used with a titanium superplastic restraining sheet 42 having a thickness of only 0.010", when a steel sheet having a thickness of 0.025" is inserted between sheets 28 and 42. The non-superplastic sheet 54, together with the restraining sheet 42 are separated from the superplastically formed completed panel structure following removal thereof from the die.

The panel structure of the invention has utility as a structural component e.g. in automotive vehicles and particularly aerospace vehicles.

While both of the face sheets 28 and 30 can be comprised of superplastic material, if desired, only the upper face sheet 28 can be formed of superplastic material, while the lower face sheet 30, which is not formed or expanded during superplastic forming, can be comprised of non-superplastic material.

Panel structures containing more than three sheets can be made by the invention process. Thus, a four sheet panel structure as shown at 56 in FIG. 9 can be fabricated utilizing the invention procedure. In this modification, the core sheet is comprised of two sheets 58 and 60 initially bonded to each other at spaced areas 62 as by welding. The sheets 58 and 60 are disposed between two face sheets 64 and 66. Sheet 58 is bonded as by welding to face sheet 64 at a series of spaced areas 68, and sheet 60 is similarly bonded as by welding to face sheet 66 at a series of spaced areas 70, disposed opposite the bonded areas 68. By employment of the concept of a restraining sheet in contact with one face sheet 64 during superplastic forming, and subsequent removal of such restraining sheet, as described above, the final four sheet structure 56 is obtained, with the initial core sheets 58 and 60 superplastically formed into a web 72 between wrinkle-free face sheets 64 and 66.

From the foregoing, according to the invention, it is seen that a novel simple procedure is provided incorporating means for superplastic forming of a sheet panel structure having a core web bonded to flat face sheets, without any grooves or wrinkles formed in the face sheets during superplastic forming.

Since various further changes and modifications of the invention will occur to those skilled in the art within the spirit of the invention, the invention is not to be taken as limited except by the scope of the appended claims.

What is claimed is:

1. A process for producing a panel structure which comprises providing at least one core sheet and a pair of face sheets disposed on opposite sides of said core sheet, said core sheet and at least one of said face sheets comprised of a superplastic material, said core sheet being joined to said face sheets along a plurality of spaced bonded areas, sealing the perimeter of said joined core sheet and face sheets, placing a restraining sheet in contact with said at least one of said face sheets, said restraining sheet comprised of superplastic material, providing a die having upper and lower surfaces and defining a cavity therebetween, placing the resulting assembly of core sheet, face sheets and restraining sheet in said cavity, with the other face sheet in contact with the lower die surface, heating said assembly to a temperature suitable for superplastic forming and admitting pressurized gas between said core sheet and each of said face sheets to cause superplastic forming of said core sheet and said at least one face sheet between said bonded areas, while superplastically forming said restraining sheet and applying a back pressure against said restraining sheet, thereby straining the core sheet and maintaining said restraining sheet in contact with the adjacent face sheet and maintaining the other face sheet in contact with the lower die surface, during superplastic forming, and forming a panel structure comprised of a core web bonded to flat face sheets along a plurality of bonded areas, without face sheet grooving at the areas of the bonds.

2. The process of claim 1, employing a single core sheet, the successive bonded areas of the core sheet and one face sheet being disposed between successive bonded areas of the core sheet and the other face sheet, and producing a three-sheet panel structure.

3. The process of claim 1, wherein said core sheet, said face sheets and said restraining sheet are all comprised of a superplastic material and said restraining sheet having a thickness greater than said face sheets and being stiffer than said face sheets.

4. The process of claim 3, wherein said superplastic material is a titanium alloy.

5. The process of claim 3, wherein said superplastic material is aluminum.

6. The process of claim 1, wherein said restraining sheet is comprised of a superplastic material which is stiffer than the superplastic material of said at least one face sheet and said core sheet.

7. The process of claim 1, wherein said core sheet is welded on opposite sides thereof to said face sheets by roll bonding or diffusion bonding.

8. The process of claim 1, wherein the perimeter of said core sheet and said face sheets is joined by welding.

9. The process of claim 1, said back pressure against said restraining sheet being substantial but less than the superplastic forming pressure between said core sheet and each of said face sheets.

10. The process of claim 8, the amount of superplastic forming of the core sheet and said at least one face sheet being controlled by the differential pressure between the superplastic forming pressure between the core sheet and each of the face sheets, and the back pressure applied against said face sheet, so as to prevent said face sheet grooving.

11. The process of claim 1, and including removing the superplastically formed panel structure from the die and separating said restraining sheet from the superplastically formed panel structure.

12. The process of claim 1, including inserting a non-superplastic metal sheet between said restraining sheet and said at least one of said face sheets.

13. The process of claim 12, said core sheet, face sheets and restraining sheet being titanium or an alloy thereof, said non-superplastic metal sheet being steel and extending for only a portion of the area of said restraining sheet.

14. In the process for producing a panel structure by superplastic forming in a die from a core pack comprising a core sheet joined at a plurality of bonded areas to a pair of face sheets, said core sheet and at least one of said face sheets being comprised of a superplastic material, the improvement which comprises applying a superplastic restraining sheet over the surface of said at least one of said face sheets, with the other face sheet in contact with a surface of the die prior to superplastic forming, and subjecting the resulting core pack to an internal superplastic forming pressure while superplastically forming said restraining sheet and applying a back pressure lower than the internal pressure, against said restraining sheet and maintaining said restraining sheet in contact with said one of said face sheets while maintaining the other face sheet in contact with said surface of the die.

15. The process of claim 14, wherein said core sheet, said face sheets and said restraining sheet are all comprised of the same superplastic material and said restraining sheet having a thickness greater than said face sheets and being stiffer than said face sheets.

16. The process of claim 14, said back pressure against said restraining sheet being substantial but less than the internal pressure, and the amount of superplastic forming being controlled by the differential pressure between said internal pressure and said back pressure, to prevent face sheet grooving at said bonded areas.

17. The process of claim 14, including inserting a non-superplastic metal sheet between said restraining sheet and said at least one of said face sheets.

* * * * *